US006532788B2

(12) United States Patent
Plesh, Sr.

(10) Patent No.: US 6,532,788 B2
(45) Date of Patent: Mar. 18, 2003

(54) ROLLER APPARATUS

(76) Inventor: Ronald L. Plesh, Sr., 31 Hemlock Hill, Orchard Park, NY (US) 14127

( * ) Notice: Subject to any disclaimer, the term of this patent is extended or adjusted under 35 U.S.C. 154(b) by 38 days.

(21) Appl. No.: 09/751,663

(22) Filed: Dec. 29, 2000

(65) Prior Publication Data

US 2002/0083752 A1 Jul. 4, 2002

(51) Int. Cl.[7] ..... B21B 13/14
(52) U.S. Cl. ..... 72/241.2; 72/241.4; 72/252.5
(58) Field of Search ..... 72/241.2, 252.5, 72/241.4, 246; 492/2, 16; 100/160; 384/58

(56) References Cited

U.S. PATENT DOCUMENTS 2,294,970 A * 9/1942 Fagerstrom et al. ..... 72/241.2
5,007,152 A * 4/1991 Tomizawa et al. ..... 72/252.5
5,483,812 A * 1/1996 Dempsey ..... 72/252.5
5,943,895 A * 8/1999 Lemper ..... 72/252.5
6,286,355 B1 * 9/2001 Figge et al. ..... 72/252.5

* cited by examiner

*Primary Examiner*—Ed Tolan
(74) *Attorney, Agent, or Firm*—James C. Simmons

(57) ABSTRACT

A roller assembly for use as a back-up roller for work rolls. The roller assembly comprises an axle, a roller rotatably mounted on the axle, a plurality of bearing elements rotatably positioned between the axle and roller, and at least one bushing which is eccentric to the axle and which is fixedly mounted on the axle. The eccentric bushing is rotatable for translating the roller in a radial direction thereof. In order to rotate the bushing in one of opposite circumferential directions, preferably, force is applied to a respective one of a pair of terminal ends of a groove which extends circumferentially in a radially outer surface of the eccentric bushing. Each of the axle and roller, which serve as inner and outer races respectively, preferably has a thickness radially of at least about 1 inch to provide high bearing capacity.

19 Claims, 3 Drawing Sheets

ROLLER APPARATUS

The present invention relates generally to roller apparatus such as, for example, back-up rollers used to support work rolls.

Work rolls are used in tandem sets to shape metal through compressive forces. The supporting back-up rollers tend to have a relatively larger diameter than the work rolls. Back-up rollers must be capable of applying very high forces, as much as 300,000 pounds of force.

Conventional back-up rollers comprise a bearing in which the axle is received in the inner race and the outer race is received in the roller. Bearing elements such as ball or cylindrical members are rotatably received between the races so that the roller is rotatable relative to the axle. Since there are size constraints on the rollers, the wall thickness of each of the inner and outer races for back-up roller bearings is conventionally limited to typically no more than about ½ inch. Bearings, for example, for cam followers and bearing wheels, have been provided wherein the wall thicknesses of the inner and outer races have been in excess of 1 inch. The rigidity of a race is related to its effective wall thickness (which includes the thickness of an axle or roller to which it is rigidly mounted), and the bearing capacity is a function of the rigidity of the races. Thus, the capacity of such conventional back-up rollers is limited by the rigidity of the least rigid of the races.

Back-up bearings have been provided wherein the inner race is mounted over an axle and has a variable thickness ranging between about ¾ inch and about 1 1/16 inch and wherein the outer race serves as the roller and has a variable thickness in excess of about 3 inches and the surface of which has a shore hardness of 78 to 83.

One type of back-up roller heretofore provided by Applicant to a customer comprises two spherical roller bearings with an inner race fitted to an axle and an outer race fitted to an outer shell or roller composed of AISI 4140 heat-treated steel having a Rockwell C hardness of 45. Both the bearing life and the shell life were however considered unacceptable. In order to improve the shell life and also hopefully the bearing life, the customer requested that the shell be made instead of cast 420 stainless steel having a Rockwell C hardness of 50. While this did improve the shell life, the bearing life nevertheless remained unacceptable to the customer.

As the back-up rollers wear and their outer diameters accordingly decrease, they do not bear as hard against the work rolls with the result that the work rolls are undesirably more prone to deflect. When this occurs, it has been necessary with conventional back-up rollers to replace a worn roller with a new one. It is, however, considered desirable to increase the useful life of the back-up rollers so that they may need replacement less often.

SUMMARY OF INVENTION

It is accordingly an object of the present invention to extend the useful life of the back-up rollers.

It is a further object of the present invention to simplify construction of such extended life back-up rollers while providing suitable back-up roller capacity.

In order to simplify construction of a back-up roller and provide suitable capacity thereof, in accordance with the present invention, an axle and roller serve as the inner and outer bearing races respectively, and each preferably has a thickness radially of at least about 1 inch to achieve suitable capacity.

In order to extend the useful life of such a back-up roller, in accordance with the present invention, the height (distance from the back-up roller axle to the back-up roller circumference or radially outer surface) thereof is adjustable by rotating an eccentric mount through which the axle is disposed and thereby translating the roller in a radial direction thereof. Preferably, in order to rotate the eccentric bushing, circumferential slot means is provided in the eccentric bushing, and force is applied to the eccentric bushing at ends respectively of the slot means to push the eccentric bushing in opposite circumferential directions respectively.

Back-up rollers are placed at spaced positions both circumferentially about (from overhead and from the floor) and axially along the work rolls. Each back-up roller must be accurately positioned, both top to bottom and left to right, and custom precision grinding is required to achieve the necessary accuracy during every changeover.

A set of experimental back-up rollers with eccentric mounts were installed for the customer in 1995. Since the installation was experimental, it was necessary to provide the customer with essentially unconditional support, which has continued to the present, to get the back-up rollers to work, and, since 1995, various modifications have been tried to address various problems. The major modifications are discussed hereinafter. Only during the current year, 2000, has it become apparent from various test and performance data including roller life data that the back-up roller has been improved to such an extent that it may now be sold to other customers. Applicant has not sold or offered for sale or even shown to other customers the back-up roller due to its experimental nature. While a longer roller life was based in 1995 on calculations and thus theoretical, performance data in 1998 indicated that the rollers were wearing too fast and thus unacceptably not giving the desired roller life. Modifications to reduce roller wear and thus provide the desired longer life were then made. It was not until this year, 2000, that it was confirmed with test and performance data from the modifications made in 1998 that, with additional improvements made in 2000, the desired roller life would finally be achieved. There have also been problems over the years since the installation other than the roller wear problem to be solved before the roller apparatus could be considered viable as a commercial product. It was, for example, necessary to improve the eccentric bushing placement so that it stayed tight and did not damage the housing and then to confirm that it would remain tight over a long period of time (years). Another major problem was insufficiency of the amount of height adjustment.

It is also important that, after any height adjustment, all of the roller elements share the load.

As initially installed, the roller height was adjustable through about 0.008 inch. It was discovered that the end plates (which enclose the rolling elements at the ends and which are fitted in cutouts in the roller) were cracking. This was corrected by increasing the radiuses of end plate corners and corresponding cutout corners from about 1/32 inch to about 3/32 inch and by press fitting (instead of slip-fitting) the end plates into position in order to reduce distortion and flexing of the roller. A bevel was also added to the roller to reduce stresses in the roller corners.

In order to improve the bearing life, the back-up rollers were made with the inner race serving as the axle and the outer race serving as the roller, and the outer race was made of a two-piece or laminated construction comprising an outer member of cast 420 stainless steel having a Rockwell C hardness of 50 (so as to not mark the work rolls) and a harder inner sleeve of AISI 52100 bearing steel having a Rockwell C hardness of 60. When test results showed in 1998 that, although the back-up roller assembly life had been improved, the outer members were wearing and in some cases fatiguing (cracks in corners of end plates) too rapidly, they were improved by making the roller as a single piece of D2 tool steel having a Rockwell C hardness of 60 (option 1) for higher wear resistance as well as strength and hardness. Additional test results in 2000 indicated that the back-up rollers were performing as desired, but, because of the increased hardness of the D2 tool steel material, the life of the work rolls was reduced. It is now believed that by constructing the roller inner sleeve of AISI 52100 bearing steel having a Rockwell C hardness of 62 and the roller outer member of forged 420 stainless steel having a Rockwell C hardness of 52 (option 2), ideal wear of both the outer and inner members of the roller as well as the work roll should now be achieved. It was also discovered that some applications are of such a severe nature that the benefit of the robust construction of the solid D2 roller (option 1) would outweigh the reduced life (increased wear) of the work roll, and, accordingly, it has been decided to offer both options 1 and 2 to customers.

It was also discovered that the rolling or bearing element spacers were too tight against the axle and not adequately sharing the load and that the grease was not flowing well from the middle to the outside rolling elements. This was remedied along with the wear improvements made in 1998 by scalloping (making semi-circular cutouts) the circular edges defining the inner diameters of the spacers and by increasing the spacer outer diameter to give back surface area lost due to the scalloping. The flatness of the spacers was increased to reduce the amount of acceptable wavyness (for tighter tolerance).

It was further found that the eccentric bushing was not staying tight enough within its housing, and this was remedied by making the housing cap out of armor plate (1½ inch thick) instead of standard carbon steel.

It was also found that the amount of eccentric adjustment was insufficient especially in view of the need to adjust for inaccuracies in set-up. The angle of a pair of slots used for adjustment of the eccentric bushing was increased from 46 to 73 degrees to obtain the necessary amount of roller adjustment. When it was found that this did not achieve the desired amount of roller adjustment since adjusting set screws were oriented generally at tangents to the slots respectively, the angle was reduced to about 50.54 degrees, as illustrated at 21 in FIG. 1.

The roller apparatus of the present invention as modified by the 1998 improvements is shown in FIGS. 1 to 3 of the drawings.

The roller performance after the 1998 improvements, especially a finding that the problem of insufficient eccentric adjustment had still not been solved, indicated the need for still further improvements, which were made in the year 2000. The roller apparatus of the present invention as modified by the year 2000 improvements is shown in FIGS. 4 to 6 of the drawings.

One of the year 2000 improvements is the provision of an increased length to a closed-off grease slot to 1⅜ inch so as to open it up.

The achievable amount of roller translation or height adjustment of the eccentric bushing, which is desirably about plus or minus 0.018 inch or more (at least about 0.015 inch), was still unduly limited, i.e., only about plus or minus 0.012 inch. Thus, there was some cause other than slot length for the limited height adjustment. This problem was corrected by the improvements made in the year 2000 and discussed with reference to FIGS. 4 to 6 of the drawings.

It is accordingly an object of an aspect of the present invention to achieve adequate height adjustment for the back-up roller.

In order to achieve adequate height adjustment for the back-up roller, in accordance with an aspect of the present invention, as shown in FIGS. 4 and 5 of the drawings, a portion of the eccentric bushing between the slots, which was found to be interfering with the movement of the adjustment set screws into the slots, was removed by extending the slots to each other thus making the pair of slots into one single slot.

The above and other objects, features, and advantages of the present invention will be apparent in the following detailed description of the preferred embodiments thereof when read in conjunction with the accompanying drawings wherein the same reference numerals denote the same or similar parts throughout the several views.

DETAILED DESCRIPTION OF THE PREFERRED EMBODIMENTS

Figure 2:
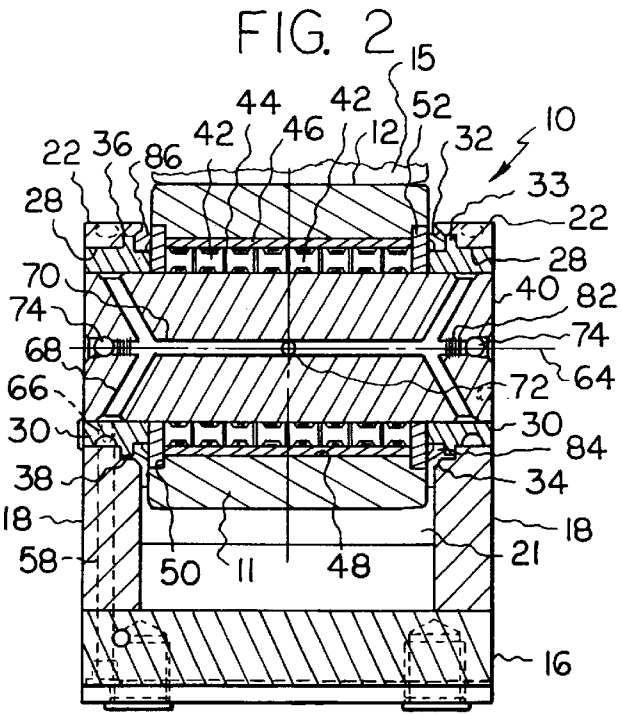
FIG. 2 is a sectional view thereof taken along lines 2—2 of FIG. 1.
Figure 3:
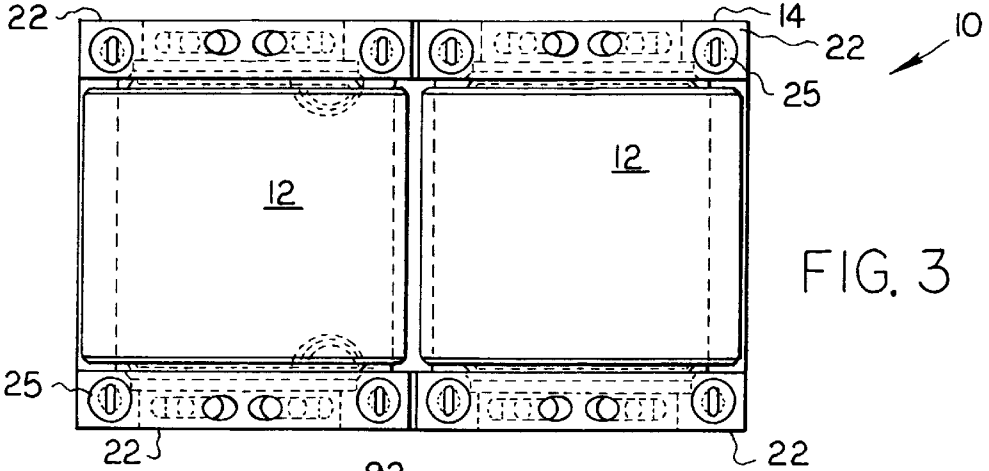
FIG. 3 is a plan view thereof.
Figure 1:
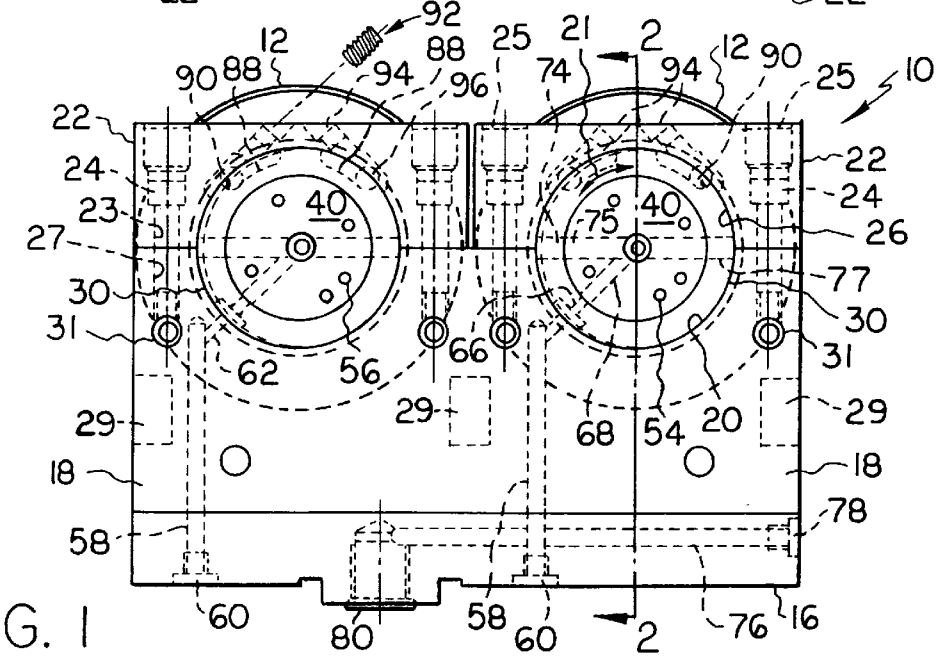
FIG. 1 is a side elevation view of apparatus which embodies the present invention.

Referring to FIGS. 1 to 3, there is shown generally at 10 an assembly of a pair of back-up rollers 12 which are used to support work rolls. It should be understood that an assembly may include only one, three, or any other number of rollers 12. Work rolls 15 are rolls which perform work on material which is passed between the work rolls, for example, flattening a sheet of metal. In order to perform the work, suitable force must be applied to the material, and back-up rollers 12 apply force to the work rolls 15 to aid them in performing the work.

The assembly 10 includes a housing 14 comprising a generally rectangular base plate 16 to opposite sides of which are attached, such as by welding or other suitable means, a pair of side plates 18 each having a pair of semi-circular openings or arches, illustrated at 20, in its upper edge for the mounting of the rollers 12 respectively. Illustrated at 29 are a plurality (the assembly is shown to have three) of beams at the ends and center of the side plates 18 respectively and about midway of the height thereof, each beam 29 extending between and suitably attached to the side plates 18 such as, for example, by welding for bracing the housing 14. A pair of cap plates 22 are attached to the upper edge of each of the side plates 18 each by means of a pair of fasteners 24 the shanks of which are received in apertures 23 in the respective cap plate 22 and which threadedly engage threaded apertures 27 in the respective side plate 18 or by other suitable means. The fasteners 24 may, for example, be socket head cap screws the heads of which are received in counterbores in the cap plates 22. Slotted (for receiving a screwdriver) plugs 25 are screwed into the upper portions of the bores to cover and protect the bolts 24. The bottoms of the threaded apertures 27 are suitably vented, and the vent holes (not shown) are closed by vent plugs 31. Each cap plate 22 has a semicircular opening or arch, illustrated at 26, in its lower edge which is complementary to the opening 20 in the respective side plate 18 to provide a circular passage, illustrated at 28, wherein the pair of passages 28 on one side of the housing are in alignment with the pair of passages 28 on the other side of the housing.

A bushing 30 is received in each of the passages 28 to rotatably (frictionally) engage the respective side plate 18 and cap plate 22 and extends axially inwardly a small distance beyond the inner side surfaces thereof. The axially inner corners of the cap and side plates 22 and 18 respectively are suitably chamfered, such as at an angle of about 45 degrees, as illustrated at 32 and 34 respectively. The bushing 30 has a circumferential ridge 33 extending from its radially outer surface which frictionally engages complementary notches 36 and 38 in the chamfered corners 32 and 34 respectively to locate the position axially of the bushing 30 and prevent its movement axially out of the assembly 10.

An axle 40 is received within each respective pair of bushings 30 and is attached thereto to prevent relative rotation therebetween by a dowel 74 or other suitable attachment means. The dowel 74 is received in a bore, illustrated at 75, which extends diametrically across the axle 40 in each end portion thereof and in bores, illustrated at 77, in the respective bushing 40.

Rotatably positioned about the axially central portion of the radially outer surface of the axle 40 are a plurality of circumferential rings or groups of roller bearing elements 42, preferably cylindrical. For example, there may be 8 side-by-side groups each having 22 roller bearing elements positioned circumferentially about the axle 40. A thin flat washer-shaped spacer member, illustrated at 44, is positioned between each group and the adjacent group of roller bearing elements 42. The radially inner axle-engaging edge of each spacer member 44 is scalloped such as by a plurality of half-moon cutouts, similarly as illustrated at 145 in FIG. 6, spaced circumferentially about the inner edge or by other suitably shaped cutouts to allow grease passage along the length of the axle.

Encircling all of the roller bearing elements 42 is a bushing or sleeve 46. For the purposes of this specification and the claims, the sleeve 46 is part of the roller 12. Thus, the roller 12 is considered to be a laminated or two-piece roller comprising the outer member 11 (which may also be referred to herein as the roller) and the sleeve 46. The sleeve is received within the bore 48 of the roller outer member 11. As discussed with reference to FIGS. 4 to 6, the roller 12 may alternatively be of a single piece construction or may otherwise be suitably constructed.

Each end of the bore 48 has an increased diameter to define a cutout, illustrated at 50, in the radially inner and axially outer surfaces of the roller outer member. An end plate 52 is received circumferentially about the axle 40 between each bushing 30 and the roller bearing elements 42 and respective sleeve 46 and is press-fit or frictionally received in the respective cutout 50 to thereby fix the position axially of the roller 12 and rotates with the roller 12. A groove is provided in the radially inner surface of each end plate 52 to receive grease to seal the radially inner surface thereof. While not shown in FIGS. 1 to 3, the groove is similar to the groove illustrated at 153 in FIG. 5. A suitable seal 84, such as an axial lip seal, is provided to extend circumferentially about each bushing 30 on the axially inner end portion thereof and with a lip 86 which engages the respective end plate 52. In addition to supporting the rolling elements 42 from skewing and coming out, the end plates 52 are provided to increase roller rigidity and thus roller stability, provide hardened surfaces to receive thrust, and to provide a hardened smooth finish for the seal 84 to rub against and thereby have longer seal life.

At 54 are bores, for example, 4 bores circumferentially spaced in each of the end walls of the axle 40 for receiving a spanner wrench for purposes of assembly. At 56 is a hole for use in driving the axle for grinding.

For each roller 12, a grease passage or bore, illustrated at 58, extends from an opening in the lower outer surface of the base plate 16 through the base plate height then partially through the height of a side plate 18 to a point of termination or blind end. A pipe plug 60 closes each grease passage opening. Access to the forward grease passage is through the opening. Since the grease passage opening for the rear roller assembly may be inaccessible, a grease passage, illustrated at 76, extends horizontally over a portion of the base plate length and connects with the passage 58 for the rear roller assembly for supply of grease thereto. The passage 76 is closable at one end in an end wall of the base plate 16, which may be a more accessible location, by a pipe plug 78 and extends beyond the corresponding grease passage 58 to a tapped hole 80 used to receive a hold-down fastener (not shown) for connecting the assembly to a floor, the passage 76 providing a vent as well as a means of lubricating the hold-down fastener.

Another grease passage, illustrated at 62, receives grease from passage 58 adjacent the blind end and extends therefrom toward the axis, illustrated at 64, of the axle 40 and to an outlet from the side plate 18. An adjoining grease passage, illustrated at 66, receives grease from passage 62 and extends radially through the bushing 30 to an outlet in the radially inner surface thereof. An adjoining grease passage, illustrated at 68, in the axle 40 receives grease therefrom and delivers it to a radially central passage, illustrated at 70, of the axle 40. The grease is delivered for lubricating the roller bearing elements 42 via a passage, illustrated at 72, which extends radially outwardly in opposite directions from an axially central point of passage 70. A threaded portion, illustrated at 82, of the passage 70 adjacent each dowel 74 receives a suitable pipe plug (not shown) to close the radially central grease passage 70.

As previously discussed, the use of a conventional bearing having inner and outer races and rolling elements therebetween interposed between the axle and roller would be limited in race thickness, the typical race thickness being about ½ inch. In accordance with the present invention, the races conventionally used are eliminated so that the rolling bearing elements 42 are disposed between the axle 40 and roller 12 which accordingly function as an inner race and an outer race respectively. This allows increased wall thickness to the "bearing races" for increased rigidity and accordingly increased bearing capacity. Thus, the roller wall radial thickness, illustrated at 149 for the embodiment of FIG. 5, may be, for example, about 1½ inch, and the axle wall radial thickness, illustrated at 155 for the embodiment of FIG. 5, may be, for example, about 1½ inch to thereby provide what is considered to be about double the capacity than would normally be provided if conventional bearings having thinner races were used. The terms "radial" and "radially" are defined, for the purposes of this specification and the claims, unless otherwise specified, as a direction toward or away from the axis 64 of axle 40, and the terms "axial" and "axially" are meant to refer to direction parallel to the axis 64. The thickness 155 would be equal to the radius of a section of the axle 40 taken in a radial plane if the axle does not contain a central passage such as lubrication passage 70 therein. The thickness 149 is meant to include the total thickness of parts of a laminated roller such as parts 11 and 46 of the roller of FIGS. 1 to 3. Preferably, the thicknesses 149 and 155 are each at least about 1 inch in order to provide adequate bearing capacity.

In order to extend the life of the back-up roller, when worn, in accordance with the present invention, the bushing 30 is eccentric, and it is rotated so as to translate the roller 12 radially to a position where it will be closer to the respective work roll so that it is in a desirable position, as when unworn, to appropriately bear against the respective work roll with sufficient force so that deflection of the work roll does not occur. In accordance with FIGS. 1 to 3, the bushing 30 is shown to be rotatable by means of a pair of circumferential slots, illustrated at 88, therein extending in opposite circumferential directions to blind or closed ends, illustrated at 90. Set screws 92 (only one shown), which may, for example, be half dog set screws, are threadedly receivable in threaded apertures, illustrated at 94, in the housing cap plate 22. These apertures 94 extend in directions circumferentially and radially inwardly of the eccentric bushing 30 toward the blind ends 90. A ball element 96 is provided in each aperture 94 ahead of the set screw 92 to afford point contact with the bushing 30 to prevent binding. The set screws 92 thus bear against the ball elements 96 which in turn bear against the blind ends to push the eccentric bushing 30 circumferentially. By pushing on the eccentric bushing 30 at the blind ends 90 by means of the set screws 92 and ball elements 96, the eccentric bushing 30 is rotatable through a small angular distance. It should be understood that other suitable means such as hydraulic cylinders, electric actuators, and mechanical levers may alternatively be provided for rotating the eccentric bushing 30, and such other rotating means are meant to come within the scope of the present invention.

Figure 4:
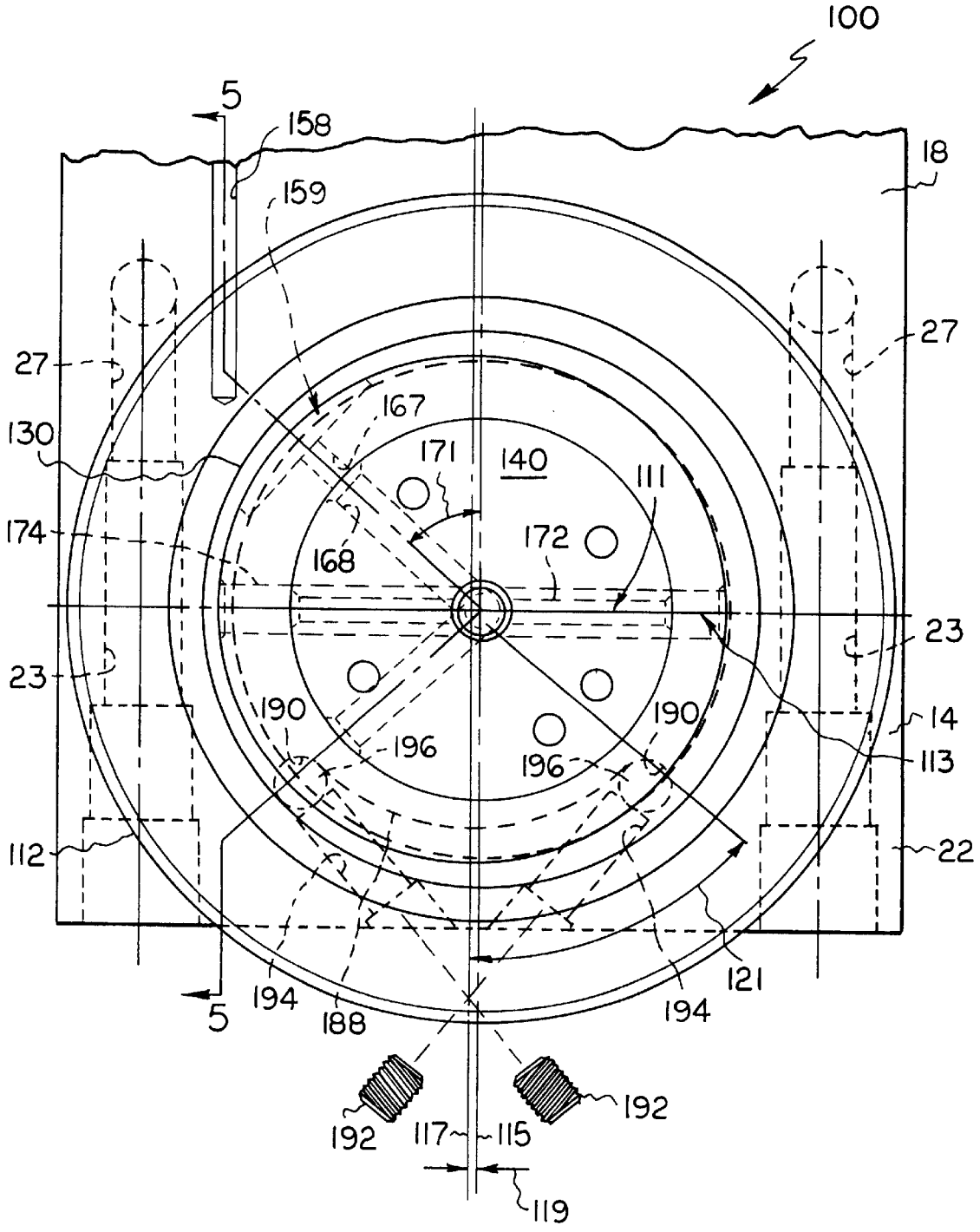
FIG. 4 is a partial side elevation view, with housing portions removed for purposes of clarity, of an improved embodiment of the apparatus.
Figure 5:
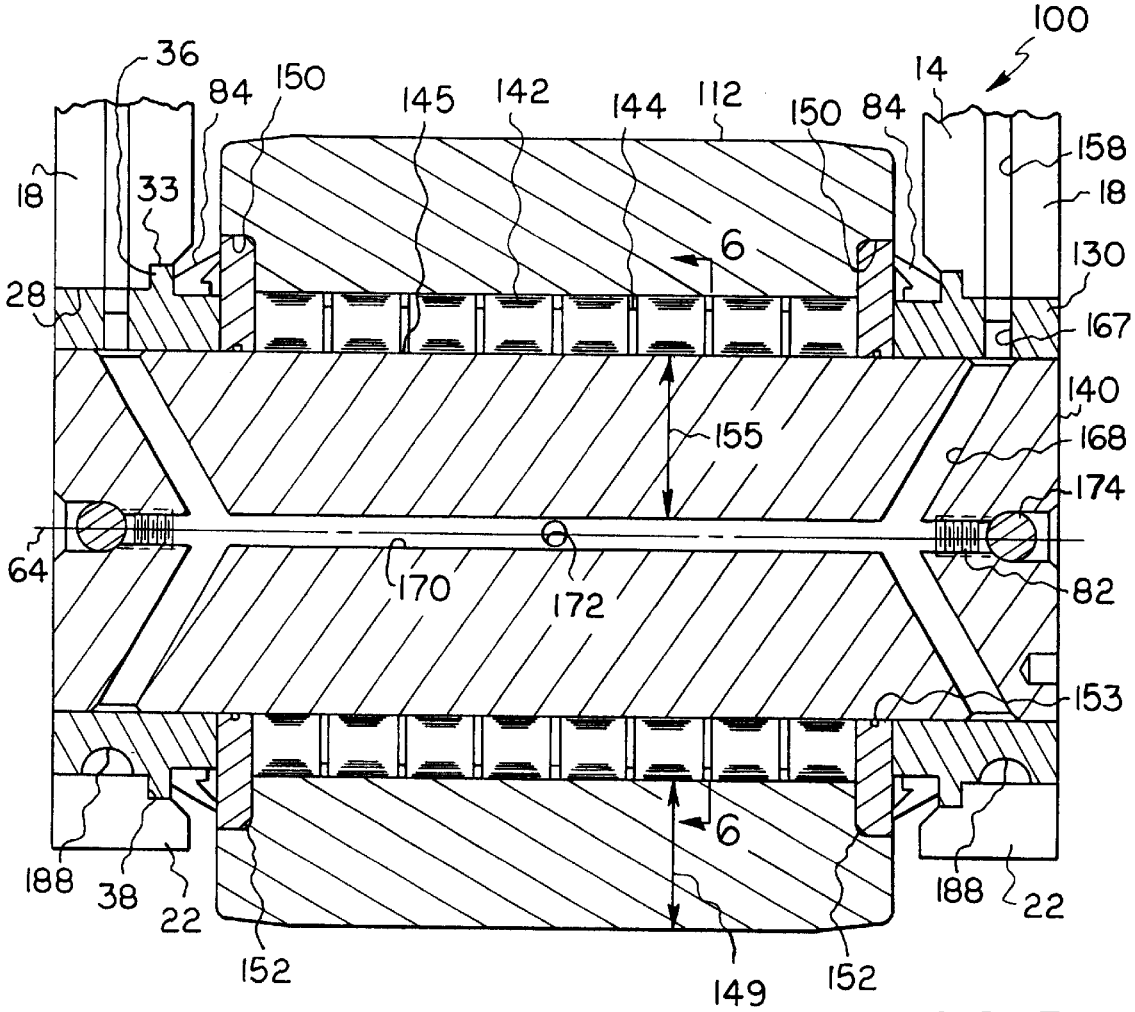
FIG. 5 is a sectional view thereof taken along lines 5—5 of FIG. 4.
Figure 6:
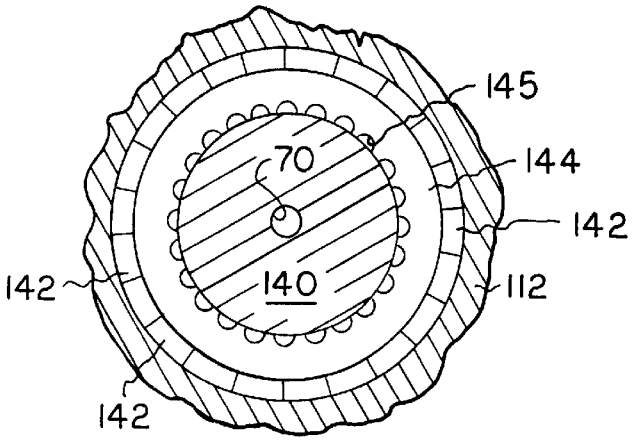
FIG. 6 is a sectional view thereof taken along lines 6—6 of FIG. 5.

The preferred embodiment of the present invention is illustrated in FIGS. 4 to 6, which, as previously discussed, contain improvements over the above discussed embodiment of FIGS. 1 to 3. The heretofore discussion of the embodiment of FIGS. 1 to 3 is applicable to the embodiment of FIGS. 4 to 6, except as otherwise indicated. Therefore, the embodiment of FIGS. 4 to 6 will now be discussed and comparisons made with the embodiment of FIGS. 1 to 3, as appropriate.

It should be noted that the embodiment of FIGS. 1 to 3 is shown upside-down from the embodiment of FIGS. 4 to 6. Since about half of the back-up rollers are normally hung from overhead, the roller assembly would normally about half of the time be orientated with the base plate being the uppermost part of the assembly, as shown in FIGS. 4 and 5.

Referring to FIGS. 4 and 5, there is shown generally at 100 a back-up roll apparatus in accordance with an alternative and preferred embodiment of the present invention. The apparatus 100 includes an axle or inner race 140, which is similar to axle 40 and the end portions of which are received within eccentric bushings 130 and fixed thereto against relative movement therebetween by dowels 174 similarly as axle 40 is fixedly received within bushings 30. The eccentric bushings 130 are in turn rotatably received within the circular passages 28 defined by the end caps 14 and side plates 18.

Rotatably positioned about the axially central portion of the radially outer surface of the axle or inner race 140 are a plurality of groups of roller bearing members 142, similarly as the roller bearing members are provided about the axle 40. The rolling bearing members 142, which are illustrated schematically in FIG. 6, are preferably cylindrical, but may otherwise be suitably shaped. A spacer member, illustrated at 144, is positioned between each circumferential group of bearing members 142 and the adjacent circumferential group of bearing members 142. The bearing members 142 are rotatably received between the inner race 140 and the roller or outer race 112. Each end of the roller 112 has a cutout, illustrated at 150, similar to cutout 50, in the radially inner roller corner. An end plate 152 is received circumferentially about the axle 140 between each bushing 130 and the roller bearing members 142 and the spacer member 144 and is frictionally received (press fit) in the respective cutout 150 to thereby fix the position axially of the roller 112 and for the other purposes as described for end plates 52.

Unlike the embodiment of FIGS. 1 to 3, the roller 112 of the apparatus 100 of the embodiment of FIGS. 4 to 6 is not laminated and thus does not include a sleeve radially inwardly thereof, with the result that the thickness (radially) of the single-part roller 112 is increased over that of the roller part 11, and the distance radially over which the cutout 150 extends is accordingly increased. As previously discussed, the sleeve (46 in FIGS. 1 to 3) is eliminated from between the roller 112 and the roller elements 142, and the roller 112, is, in this embodiment, preferably composed of D2 tool steel, which has a hardness (Rockwell C hardness of 60) sufficient to properly support the rolling elements 142, and the increased wall thickness 149 aids in roller stability and bearing life. However, if desired, a sleeve or bushing, similar to sleeve 46 in the embodiment of FIGS. 1 to 3, may be provided between the roller 112 and rolling elements 142 in order to reduce marking of the work rolls, in which case the roller is preferably made of forged 420 stainless steel having a Rockwell C hardness of 52 and the sleeve is preferably made of AISI 52100 bearing steel having a Rockwell C hardness of 62, as previously discussed.

Illustrated at 111 and 113 are index marks on the non-eccentric or circular axle 140 and the eccentric bushing 130 respectively. The thickness of the eccentric bushing 130 varies over its circumference from a maximum on the left side (as seen in FIG. 4) to a minimum on the right side. The centerpoints at the index marks 111 and 113 of the axle 140 and eccentric bushing 130 are illustrated at 115 and 117 respectively. In order to afford a desirable amount of roller height adjustment, the distance between the centerpoints 115 and 117, illustrated at 119, may be, for example, about 0.065 plus or minus 0.005 inch. Thus, by rotating the eccentric bushing 130 with the axle 140 fixed thereto, the axle 140 may be translated radially so as to be positioned closer to or farther from work rolls. The eccentric bushing 30 of the embodiment of FIGS. 1 to 3 is similarly eccentric.

When it was discovered that an increased slot length (about 73 degrees) did not improve the height adjustment ability as desired, it was determined that if the slot length were too long, both adjustment set screws, due to being oriented generally tangentially to the slot, could not satisfactorily be tightened at the same time without undesirably adding additional balls or the like. In this regard, it should be noted that maximum roller translation per a specific amount of eccentric rotation occurs when the centerline 115 is about midway of the slot and decreases as the eccentric is rotated in either direction from this mid-position. Accordingly, in order that tightening of both set screws could satisfactorily be achieved while also allowing the amount of adjustment to be maximized, the slot length was decreased to that shown in FIGS. 1 and 4, i.e., to a slot length (distance angularly between line 117 and the slot blind end 190), illustrated at 121 in FIG. 4, of about 50.54 degrees plus or minus 0.25 degrees in the eccentric bushing 130 of the embodiment of FIGS. 4 and 5. The slot length of the roller apparatus of FIGS. 1 to 3, illustrated at 21, is also about 50.54 degrees plus or minus 0.25 degrees. However, it should be understood that such a slot length is to be considered as exemplary and not for purposes of limitation.

It was, however, discovered that, irregardless of the changes in the slot length, the amount of roller translation or height adjustment of the eccentric bushing, which is desirably about plus or minus 0.018 inch, remained unduly limited, i.e., only about plus or minus 0.012 inch. Thus, there was some cause other than slot length for the limited height adjustment.

Indeed, it was discovered that a portion of the eccentric bushing between ends of the two separate slots was interfering with the movement of the adjustment set screws into the slots. In order to achieve adequate height adjustment for the back-up roller, in accordance with a preferred embodiment of the present invention, as shown in FIG. 4 of the drawings, a portion of the eccentric bushing between the slots, which was the portion found to be interfering with the movement of the adjustment set screws into the slots, was removed by extending the slots to merge into each other thus making the pair of slots into one single slot. Accordingly, instead of the two separate slots shown in FIGS. 1 to 3, each eccentric bushing 130 of a preferred embodiment of the present invention has a single slot, illustrated at 188, extending, in the radially outer surface thereof, between two opposed blind or closed ends 190. Preferably, the angular slot length 121 (which it should be noted is half of the distance angularly between the blind ends 190 of the single slot) is between about 50 and 70 degrees, more preferably between about 50 and 55 degrees, so that it may be long enough to achieve the desired roller translation of up to about 0.018 inch yet not be so long as to prevent the set screws from being satisfactorily tightened. Similarly as for the embodiment of FIGS. 1 to 3, a threaded aperture, illustrated at 194, is provided in the respective cap plate 22 and directed to extend circumferentially and radially inwardly toward the respective blind end 190, and a set screw 192 thereadedly receivable therein to bear against a ball element 196 received therein to make point contact with the blind end 190 to push the eccentric bushing 130 circumferentially, in one direction circumferentially at one blind end 190 and in the other direction circumferentially at the other blind end 190, to adjustably effect translation of the axle 140 radially.

The following example is provided for exemplary purposes only and not for purposes of limitation. The assembly 100 of FIGS. 4 and 5 may, for example, have an axle length of about 10.485 inches, an axle diameter of about 3 13/16 inches, a roller length of about 7 1/16 inches, roller outer and inner diameters of about 8.313 and 5.1 inches respectively, an eccentric bushing outer diameter of about 5.126 inches, a thickness and radial height of the end plates 152, which are armor plated, of about 3/8 inch and 1 inch respectively, a thickness of spacers 144 of about 1/16 inch, and an axle dowel diameter of about 1/2 inch. The eccentric bushing ridge 33 has a thickness of about 1/4 inch and is spaced from the axially outer end of the eccentric bushing a distance of about 0.998 inch and from the centerline of the grease passage 158 a distance of about 0.375 inch. The end caps 22 and side plates 18 each have a thickness of about 1 1/2 inch. The grease passage 158 has a diameter of about 1/4 inch, and its centerline is spaced a distance of about 2 1/2 inches from the vertical centerplane of the axle. The grease slot pocket, illustrated at 159, in the eccentric bushing at its interface with the side plate 18 has a width and length of about 1/4 inch and 1 3/8 inch respectively, desirably large enough to insure that the grease passage is not closed off when the eccentric bushing and axle are rotated to a different angular position during height adjustment. From the grease slot 159, grease passages 167 and 168 extend through the eccentric bushing and axle respectively at an angle, illustrated at 171, of about 46 degrees to the radially central grease passage 170. The ball elements 196 have a diameter of about 13.494 mm, and the slot 188 is milled to a diameter of about 0.56 inch. The set screws 192 are 1/2 inch diameter half dog set screws.

In order to adjustably translate the roller 12 or 112 radially toward or away from a work roll, the eccentric bushing 30 or 130 is rotated in a circumferential direction by use of one of the set screws to apply force to the blind end 90 or 190 which corresponds to the desired direction of rotation of the bushing by (1) unscrewing the other set screw 92 or 192 so as to allow the rotation to occur, then (2) screwing the set screw 92 or 192 corresponding to the desired direction of rotation inwardly to bear on the ball element 96 and thereby push against the respective blind end 90 or 190 thereby pushing the eccentric bushing circumferentially, then (3) tightening the other set screw so that both set screws are tight to lock the bushing in the re-set position. The apparatus as described herein is provided to allow rotation through about 30 degrees in either direction to achieve a roller translation of up to about 0.018 inch (at least about 0.015 inch).

It should be understood that, while the present invention has been described in detail herein, the invention can be embodied otherwise without departing from the principles thereof, and such other embodiments are meant to come within the scope of the present invention as defined by the appended claims.

What is claimed is:

1. A roller assembly comprising an axle, a roller rotatably mounted on said axle, at least one bushing which is eccentric to said axle and which is fixedly mounted to said axle so that said axle rotates as said eccentric bushing is rotated, said eccentric bushing being rotatable for translating said axle in a radial direction of said axle thereby translating said roller in a radial direction of said roller.

2. A roller assembly according to claim 1 further comprising a plurality of bearing elements rotatably positioned between said axle and said roller whereby said axle serves as an inner race and said roller serves as an outer race of the assembly.

3. A roller assembly according to claim 2 further comprising an end plate rotatably disposed on said axle between said eccentric bushing and said roller and said bearing elements.

4. A roller assembly comprising an axle, a roller rotatably mounted on said axle, at least one bushing which is eccentric to said axle and which is fixedly mounted on said axle, said eccentric bushing being rotatable for translating said roller in a radial direction of said roller, the roller assembly further comprising circumferentially extending groove means in a radially outer surface of said eccentric bushing and which has terminal ends, and means for applying force to each of two of said terminal ends for rotating said eccentric bushing in opposite circumferential directions respectively.

5. A roller assembly according to claim 4 further comprising a housing member in which said eccentric bushing is rotatably received, means defining a pair of threaded apertures in said housing member, and screws in said threaded aperture means respectively in position for engaging and applying force to said terminal ends respectively for rotating said eccentric bushing.

6. A roller assembly according to claim 5 further comprising at least one ball element disposed between each of said terminal ends and said respective screw.

7. In combination with a work roll, at least one roller assembly for applying force to the work roll, the roller assembly comprising an axle, a roller, and a plurality of bearing elements rotatably positioned between and bearing against said axle and said roller whereby said axle serves as an inner race and said roller serves as an outer race of the assembly.

8. A roller assembly according to claim 7 wherein each of said axle and said roller has a thickness radially of at least about 1 inch.

9. A roller assembly according to claim 7 further comprising at least one bushing which is eccentric to said axle and which is fixedly mounted on said axle, said eccentric bushing being rotatable for translating said roller in a radial direction of said roller.

10. A roller assembly according to claim 9 further comprising an end plate rotatably disposed on said axle between said eccentric bushing and said roller and said bearing elements.

11. A roller assembly according to claim 7 wherein said bearing elements are arranged in a plurality of circumferential rings each of which has a plurality of said bearing elements arranged about said axle, the roller assembly further comprising a spacer member disposed between each adjacent pair of said bearing element rings, said spacer member having a radially inner edge which has means defining a plurality of cutouts therein.

12. A roller assembly according to claim 11 wherein said bearing elements are cylindrical members.

13. A roller assembly according to claim 7 wherein said bearing elements are cylindrical members.

14. In combination with a work roll, at least one roller assembly for applying force to the work roll, the roller assembly comprising an axle, a roller, a plurality of bearing elements rotatably positioned between said axle and said roller whereby said axle serves as an inner race and said roller serves as an outer race of the assembly, at least one bushing which is eccentric to said axle and which is fixedly mounted on said axle, said eccentric bushing being rotatable for translating said roller in a radial direction of said roller, circumferentially extending groove means in a radially outer surface of said eccentric bushing and which has terminal ends, and means for applying force to each of two of said terminal ends for rotating said eccentric bushing in opposite circumferential directions respectively.

15. A method of adjusting force applied to a work roll by a back-up roller rotatably mounted on an axle, the method comprising (1) providing at least one bushing eccentric to and fixedly mounted to the axle so that the axle rotates as the eccentric bushing is rotated, and (2) rotating the eccentric bushing to translate the axle in a radial direction of the axle thereby translating the roller in a radial direction of the roller to thereby adjust force applied to the work roll.

16. A method according to claim 15 wherein the step of rotating the eccentric bushing comprises applying force to a terminal end of circumferentially extending groove means in a radially outer surface of the eccentric bushing.

17. A method according to claim 15 further comprising providing the rotatable mounting of the roller on the axle to comprise a plurality of bearing elements rotatably positioned between and bearing against the axle and the roller whereby the axle serves as an inner race and the roller serves as an outer race.

18. A roller assembly for applying force to a work roll, the roller assembly comprising a housing including a pair of side plates and a pair of housing caps which housing caps are attached to said side plates respectively to define a pair of openings respectively, at least one of said housing caps composed of armor plate, an axle having a thickness radially of at least about 1 inch, a roller comprising a single piece of D2 tool steel having a Rockwell C hardness of 60 and having a thickness radially of at least about 1 inch and having at least one radially inner cut-out in an axially outer surface thereof, a plurality of cylindrical bearing elements rotatably positioned between and which bear against said axle and said roller whereby said axle serves as an inner race and said roller serves as an outer race of the assembly, said bearing elements arranged in a plurality of circumferential rings each of which has a plurality of said bearing elements arranged about said axle, a spacer member disposed between each pair of adjacent ones of said bearing element rings, said spacer member having a radially inner edge which has a plurality of cut-outs therein, at least one bushing which is eccentric to said axle and which is fixedly mounted to said axle so that said axle rotates as said eccentric bushing is rotated, said eccentric bushing being received in one of said openings, an end plate rotatably disposed on said axle between said eccentric bushing and said bearing elements and press fit in said roller cutout, said eccentric bushing being rotatable for translating said axle in a radial direction of said axle for translating said roller in a radial direction of said roller, circumferentially extending groove means in a radially outer surface of said eccentric bushing and having at least two terminal ends, a pair of threaded apertures in said respective cap member for receiving screws for applying force to said terminal ends respectively for rotating said eccentric bushing in opposite circumferential directions respectively.

19. A roller assembly for applying force to a work roll, the roller assembly comprising a housing including a pair of side plates and a pair of housing caps which housing caps are attached to said side plates respectively to define a pair of openings respectively, at least one of said housing caps composed of armor plate, an axle having a thickness radially of at least about 1 inch, a roller comprising an inner member of AISI 52100 bearing steel having a Rockwell C hardness of 62 and an outer member of forged 420 stainless steel having a Rockwell C hardness of 52, said roller having a thickness radially of at least about 1 inch and having at least one radially inner cut-out in an axially outer surface thereof, a plurality of cylindrical bearing elements rotatably positioned between and which bear against said axle and said roller whereby said axle serves as an inner race and said roller serves as an outer race of the assembly, said bearing elements arranged in a plurality of circumferential rings each of which has a plurality of said bearing elements arranged about said axle, a spacer member disposed between each pair of adjacent ones of said bearing element rings, said spacer member having a radially inner edge which has a plurality of cut-outs therein, at least one bushing which is eccentric to said axle and which is fixedly mounted to said axle so that said axle rotates as said eccentric bushing is rotated, said eccentric bushing being received in one of said openings, an end plate rotatably disposed on said axle between said eccentric bushing and said bearing elements and press fit in said roller cut-out, said eccentric bushing being rotatable for translating said axle in a radial direction of said axle for translating said roller in a radial direction of said roller, circumferentially extending groove means in a radially outer surface of said eccentric bushing and having at least two terminal ends, a pair of threaded apertures in said respective cap member for receiving screws for applying force to said terminal ends respectively for rotating said eccentric bushing in opposite circumferential directions respectively.

* * * * *